United States Patent [19]

Sato et al.

[11] Patent Number: 4,531,904

[45] Date of Patent: Jul. 30, 1985

[54] LOW $NO_x$ LEVEL COMBUSTION METHOD IN A RADIANT TUBE BURNER AND A BURNING APPARATUS USED FOR THE METHOD

[75] Inventors: Kuniaki Sato; Shinichiro Muto, both of Chiba; Fumiya Yanagishima; Yuji Shimoyama, both of Ichihara, all of Japan

[73] Assignee: Kawasaki Steel Corporation, Kobe, Japan

[21] Appl. No.: 667,080

[22] Filed: Nov. 1, 1984

Related U.S. Application Data

[63] Continuation of Ser. No. 274,421, Jun. 17, 1981, abandoned.

[30] Foreign Application Priority Data

Jun. 27, 1980 [JP] Japan ..... 55-87475

[51] Int. Cl.[3] ..... F23M 3/04

[52] U.S. Cl. ..... 431/10; 126/91 A; 431/11; 431/187; 431/242; 431/353

[58] Field of Search ..... 431/2, 10, 174, 187, 431/188, 242, 247, 284, 285, 351, 353; 432/209; 126/91 A

[56] References Cited

U.S. PATENT DOCUMENTS

| | | | |
|---|---|---|---|
| 1,995,934 | 3/1935 | Mangold | 239/419 |
| 2,148,466 | 2/1939 | Hepburn et al. | 431/285 X |
| 2,823,740 | 2/1958 | Morck | 431/12 |
| 2,932,347 | 4/1960 | Jaeger | 431/285 X |
| 3,182,711 | 5/1965 | Robb | 431/353 |
| 3,280,882 | 10/1966 | Hemker | 431/79 |
| 3,512,219 | 5/1970 | Stern et al. | 431/187 X |
| 3,934,522 | 1/1976 | Booker | 110/349 X |
| 4,162,140 | 7/1979 | Reed | 431/284 |

FOREIGN PATENT DOCUMENTS

| | | | |
|---|---|---|---|
| 987584 | 4/1976 | Canada | 431/8 |
| 1000231 | 8/1965 | United Kingdom | 431/284 |
| 373486 | 5/1973 | U.S.S.R. | 431/187 |
| 723299 | 3/1980 | U.S.S.R. | 431/187 |

*Primary Examiner*—Samuel Scott
*Assistant Examiner*—Carl D. Price
*Attorney, Agent, or Firm*—Balogh, Osann, Kramer, Dvorak, Genova & Traub

[57] ABSTRACT

A method of burning a fuel gas in a low $NO_x$ level in the exhaust gas is disclosed, wherein a radiant tube burner having concentrically arranged outer air flow nozzle, fuel gas nozzles arranged in a circle and inner air flow nozzle and having a particular structure is used and the fuel gas is burnt under a particularly limited condition.

2 Claims, 10 Drawing Figures

LOW $NO_x$ LEVEL COMBUSTION METHOD IN A RADIANT TUBE BURNER AND A BURNING APPARATUS USED FOR THE METHOD

This application is a continuation of application Ser. No. 274,421, filed June 17, 1981, now abandoned.

BACKGROUND OF THE INVENTION (1) Field of the Invention

The present invention relates to a low $NO_x$ level combustion method in a radiant tube burner and to a combustion apparatus used for the method, and provides a technic for suppressing the generation of $NO_x$ by carrying out a smooth two-stage combustion in the interior of a radiant tube.

(2) Description of the Prior Art

In general, when a fuel gas is burnt by a burner arranged in a radiant tube used in an annealing installation, a high load combustion must be carried out in a narrow tube, and therefore the combustion by the burner in the radiant tube has a drawback that the amount of $NO_x$ gas generated in the combustion by the radiant tube burner is larger than the amount of $NO_x$ gas generated in the combustion by an ordinary industrial furnace, wherein fuel is burnt in a large space. Moreover, it is difficult to decrease the $NO_x$ level in a radiant tube burner by merely applying a low $NO_x$ level combustion means used in an ordinary industrial furnace to the radiant tube burner, and further it is difficult to produce a nozzle which is adapted to be used in a small-diameter radiant tube and has a structure for carrying out a low $NO_x$ level combustion. Accordingly, low $NO_x$ level combustion can not substantially be attained by merely modifying the burner structure in the radiant tube, and indeed there has never been known a radiant tube burner capable of attaining a satisfactorily low $NO_x$ level combustion.

SUMMARY OF THE INVENTION

The present invention discloses a technic free from the above described drawbacks of conventional technics, and provides a combustion method, wherein a smooth and uniform two-stage combustion is carried out in the interior of a radiant tube to decrease the $NO_x$ level in the exhaust gas to a satisfactorily low level, and a combustion apparatus to be used for the low $NO_x$ level combustion.

That is, one of features of the present invention is to provide a low $NO_x$ level combustion method in a radiant tube burner, wherein an inner air flow is made to flow in an inner air flow conduit and jetted into a secondary combustion region through an inner air flow nozzle; a fuel gas flow in the form of a hollow tube surrounding the inner air flow is jetted into a primary combustion region through fuel gas nozzles, which are arranged in a chamber bottom so as to surround the inner air flow conduit; an outer air flow surrounding the above described fuel gas flow is jetted into the primary combustion region through the outer peripheral portion of the chamber; and the fuel gas is primarily burnt by the outer air flow and then secondarily burnt by the above described inner air flow, the improvement comprising forming a jet of the fuel gas by means of 3~6 fuel gas nozzles arranged in the above described chamber; carrying out a primary combustion of the fuel gas by controlling the ratio of the amount of the inner air flow to the total amount of the introduced air to 35~80%, and limiting the momentum ratio of the fuel gas jet to the outer air flow to not lower than 0.40; and further carrying out the secondary combustion of the primarily burnt fuel gas by setting the length of the inner air flow conduit to not smaller than 200 mm.

Another feature of the present invention is to provide a low $NO_x$ level combustion apparatus in a radiant tube burner, having an inner air flow conduit for flowing an inner air flow therethrough, fuel gas nozzles arranged so as to surround the inner air flow conduit, and a nozzle for jetting an outer air flow, the nozzle being arranged so as to surround the fuel gas nozzles, the improvement including the inner air flow conduit arranged in the center portion of a radiant tube, the inner air flow conduit having at its tip an inner air flow nozzle and a length of not smaller than 200 mm; and a chamber arranged around the inner air flow conduit, the chamber having a rim projected from the peripheral edge thereof and having 3~6 fuel gas flow conduits arranged in a circle in the bottom, the fuel gas flow conduits opening into the chamber to form fuel gas nozzles; thereby forming an outer air flow nozzle between the rim of the chamber and the inner wall surface of the radiant tube.

DESCRIPTION OF THE PREFERRED EMBODIMENT

Figure 1:
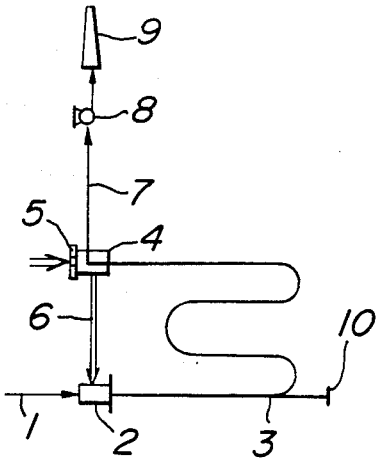
FIG. 1 is a schematic view showing a controlling system of a low $NO_x$ level combustion and of an apparatus used in the method.

The present invention will be explained in more detail referring to FIGS. 1~8. FIG. 1 illustrates the whole control system for carrying out the low $NO_x$ level combustion according to the present invention. In FIG. 1, the numeral 1 represents a supply pipe for fuel gas, the numeral 2 represents a radiant tube burner, the numeral 3 represents a radiant tube, the numeral 4 represents a preheater for combustion air, which is arranged on outlet side of the radiant tube, the numeral 5 represents an air inlet, the numeral 6 represents an air conduit, the numeral 7 represents an exhaust gas conduit, the numeral 8 represents a blower for sucking exhaust gas, and the numeral 9 represents a chimney. In this controlling system, a given amount of combustion air is sucked into the system through an air inlet 5 by a suction pressure of exhaust gas, which suction pressure is determined depending upon the flow rate of fuel gas, and the combustion air is preheated in the preheater 4 and then supplied into the radiant tube burner 2 through the air conduit 6. The numeral 10 represents a viewing window for observing flame.

Figure 2A:
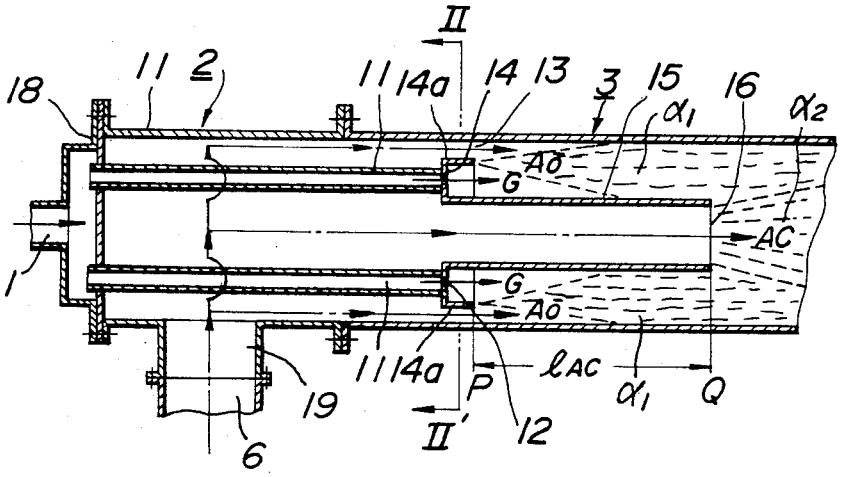
FIG. 2*a* is a longitudinal sectional view of one embodiment of the radiant tube burner according to the present invention.
Figure 2B:
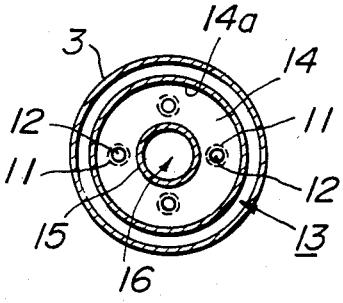
FIG. 2*b* is a cross-sectional view of the radiant tube burner shown in FIG. 2*a* taken on a line II—II' in the arrow direction.

FIGS. 2*a* and 2*b* illustrate one embodiment of a radiant tube burner according to the present invention. In the radiant tube burner 2 illustrated in FIGS. 2*a* and 2*b*, a plurality of fuel gas conduits 11 are arranged in a circle in a radiant tube 3 and opened into the bottom or inlet end of an annular chamber 14, being spaced apart from and disposed concentrically with the inner wall surface of the radiant tube, which has a rim 14*a* integrally formed at its peripheral edge, through fuel gas nozzle 12, located at the outlet end or peripheral edge of chamber 14 . A gap having a given width is formed between the inner wall surface of the radiant tube 3 and the rim 14*a* formed at the periphery of the chamber 14, and the gap is used as an outer air passage or nozzle 13, through which outer combustion air flow is jetted into a primary combustion region $\alpha_1$. Further, an inner air flow conduit 15 is arranged in the center portion of the chamber 14 and protruded or extended forwardly downstream from the chamber in the flowing direction of fuel gas along the tube axis so as to flow therein the inner combustion air flow. The tip or the free open end of the inner air flow conduit 15 is formed into an inner air flow nozzle 16.

The air conduit 6 is connected to an air-supply tube 19 formed in the radiant tube 3, and combustion air, which is introduced into the radiant tube 3 through the air-supply hole 19, is separated into two flows by the chamber 14, one of which is jetted into the primary combustion region $\alpha_1$ through the above described outer air flow nozzle 13 and used as an outer combustion air flow, and the other of which is passed through the inner air conduit 15, jetted into a secondary combustion region $\alpha_2$ through the inner air flow nozzle 16 and used as an inner combustion air flow. The ratio of the outer combustion air flow rate to the inner combustion air flow rate is determined by the cross-sectional area ratio of the nozzle 13 to the nozzle 16. In FIG. 2*a*, the numeral 18 represents a partition wall, which separates a space for introducing combustion air from the fuel gas conduit 11, which is connected to the supply pipe 1 for fuel gas, in the radiant tube 3.

As described above, the protruded length of the tip P of the chamber 14, that is, of the outer air flow nozzle, from the bottom of the chamber 14 is smaller than the protruded length of the tip Q of the inner air flow nozzle 16 from the bottom of the chamber 14. Therefore, fuel gas is primarily burnt by the outer air flow $A\bar{o}$ in an annular gap formed between the inner air flow conduit 15 and the radiant tube 3, and further is secondarily burnt from the center portion of the fuel gas jet G by the inner air flow Ac at the portion beyond the tip Q of the inner air flow nozzle.

Good results were obtained in experiments by using the radiant tube burner illustrated in FIGS. 2*a* and 2*b*. Relations between the burner factors of the radiant tube burner of the present invention and the formation of $NO_x$ will be explained based on the experimental data, and burner factors capable attaining the low $NO_x$ level combustion will be explained hereinafter.

The inventors have found out that the main burner factors in a radiant tube burner are the following four factors.

1. Ratio of inner air flow Ac:

Ratio of $Ac/(Ac+A\bar{o})$, which is determined by the cross-sectional areas of apertures of the inner air flow nozzle 16 and outer air flow nozzle 13.

2. Number of holes of multigas nozzles:

3. Momentum ratio of the fuel gas jet to the outer air flow $A\bar{o}$:

Ratio of $MG/MA\bar{o}$, which is determined by the jet velocity of fuel gas and the jet velocity of outer air flow.

4. The length of inner air flow conduit, that is, the length of the primary combustion region $\alpha_1$:$l_{Ac}$ The test was carried out by using a continuous annealing furnace under the following condition; temperature in the furnace: 900° C., exhaust gas temperature: 950° C., average temperature of radiant tube: 950°~1,000° C., fuel gas: coke oven gas having a calorific value of 4,350 Kcal/Nm$^3$, burner capacity: $110\times10^3$ Kcal/hr, diameter of radiant tube: 6B (indication by JIS), preheated air temperature: 350°~400° C., the amount of excess $O_2$: 2~3%. In the above described test, in addition to the measurement of the $NO_x$ level, the state of flame was observed by naked eye through a viewing window 10 arranged in the radiant tube at a portion opposed to the burner, and a relation between the state of flame and the burning behavior of the fuel gas was examined. The results will be explained hereinafter.

FIGS. 3~6 illustrate relations between the influence of the above described burner factors upon the formation of $NO_x$ and the burning behavior of the fuel gas. As seen from FIG. 3, when an inner air flow ratio (Ac ratio), which is given by $Ac/(Ac+A\bar{o})$, is within the range of 35~80%, a low $NO_x$ level combustion can be carried out. When the Ac ratio is not higher than 30%, fuel gas is rapidly burnt to form a blue flame in the primary combustion region $\alpha_1$, and the secondary combustion by the inner air flow Ac is not smoothly carried out, and hence the two-stage combustion aimed in the present invention is not substantially carried out. While, when the Ac ratio is higher than 80%, the primary combustion is carried out in a very small amount in the primary combustion region $\alpha_1$, and a major part of the fuel gas is substantially burnt in the secondary combustion region $\alpha_2$ by the inner air flow Ac, and the flame is blue in the center portion and red in the peripheral portion. On the contrary, when the Ac ratio is within the range of 35~80%, a low $NO_x$ level combustion is carried out, and a thin filmy flame is formed. That is, fuel gas is properly mixed with air in both of the primary combustion step by the outer air flow $A\bar{o}$ and the secondary combustion step by the inner air flow Ac.

Figure 4:
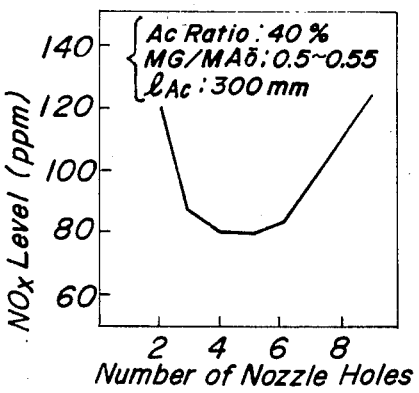
FIG. 4 is a graph illustrating a relation between the number of holes of fuel gas nozzles and the $NO_x$ level in the exhaust gas.

FIG. 4 illustrates a relation between the number of holes of gas nozzles 12 and the $NO_x$ level in the exhaust gas. The formation of $NO_x$ is highly influenced by the number of holes of gas nozzles 12. When the number of nozzle holes is 3~6, a low $NO_x$ level combustion can be carried out. The state of flame was observed in the tests using 2 holes and 8 holes. In the case of 2 holes, gas-rich red flame portion and air-rich blue flame portion coexist in the flame in its peripheral direction. While, in the case of 8 holes, the flame is formed into an intensely blue-colored flame in the outer peripheral portion of the primary combustion region $\alpha_1$, that is, in the initial combustion portion of the fuel gas by the outer air flow $A\bar{o}$. These facts mean that, in the case of 2 holes, fuel gas jetted from the 2 holes is not uniformly distributed around the inner air flow conduit 15 in its peripheral direction, and high $O_2$ level portions are formed in both the primary combustion region $\alpha_1$ and the secondary combustion region $\alpha_2$ to cause high $NO_x$ level combustion in both the primary combustion region $\alpha_1$ and the secondary combustion region $\alpha_2$. While, in the case of 8 holes, the number of nozzle holes is sufficiently large, and therefore a large amount of fuel gas is supplied into the primary combustion region $\alpha_1$ and is initially mixed with the outer air flow $A\bar{o}$ in the region $\alpha_1$. Accordingly, a primary combustion is uniformly carried out in the peripheral direction in the primary combustion region $\alpha_1$, and a low $NO_x$ level combustion can be carried out.

Figure 3:
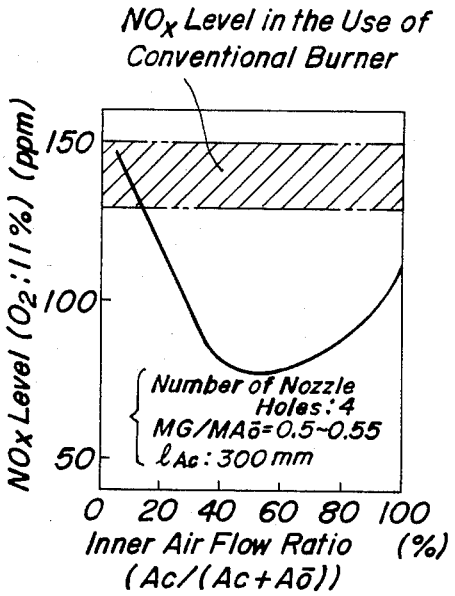
FIG. 3 is a graph illustrating a relation between the inner air flow ratio and the $NO_x$ level in the exhaust gas.

It can be seen from the results of experiments shown in FIGS. 3 and 4 that, when the radiant tube burner according to the present invention illustrated in FIG. 2*a* is used, a low $NO_x$ level combustion can be carried out in the case where a primary combustion by the outer air flow $A\bar{o}$ in the region $\alpha_1$ and a secondary combustion by the inner air flow Ac in the region $\alpha_2$ are smoothly carried out in two stages and a uniform redish-purple thin filmy flame is formed; and that, as the burner factors, an inner air flow ratio (Ac ratio) of 35~80%, and the number of holes of multigas nozzles of 3~6 are preferable.

Figure 5:
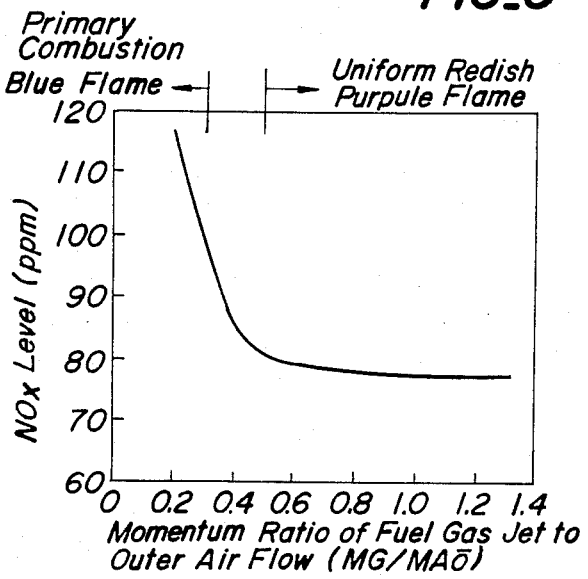
FIG. 5 is a graph illustrating a relation between the momentum ratio of fuel gas jet to outer air flow and the $NO_x$ level in the exhaust gas.

As another factor for determining the burning state of fuel gas in the primary combustion region $\alpha_1$, the momentum ratio $MG/MA\bar{o}$, wherein MG is the momentum of fuel gas jet and $MA\bar{o}$ is the momentum of outer air flow, must be taken into consideration. FIG. 5 illustrates the results of the investigation of the influence of the momentum ratio upon the burning state. In general, when a burner having concentrically arranged fuel gas and air nozzles is used, the length of flame is smaller as the momentum ratio $MG/MA\bar{o}$ is lower. While, when the momentum ratio $MG/MA\bar{o}$ is not lower than 0.40, the $NO_x$ level in the exhaust gas is low. Particularly, when the momentum ratio $MA/MA\bar{o}$ is not lower than 0.45, $NO_x$ is substantially saturated in the exhaust gas in a low level, and a uniform redish-purple flame is obtained.

Figure 6:
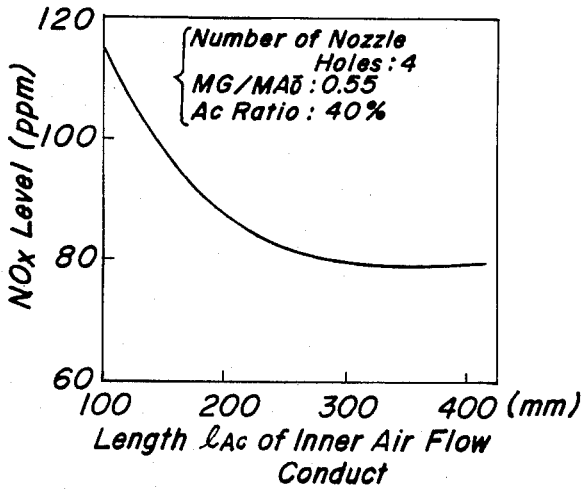
FIG. 6 is a graph illustrating a relation between the length of inner air flow conduit and the $NO_x$ level in the exhaust gas.

Of course, the length $l_{Ac}$ of the inner air flow conduit has a high influence upon the smooth two-stage operation of the primary and secondary combustions. FIG. 6 illustrates the results of the investigation of the influence. When the conduit length Ac is not smaller than 200 mm, $NO_X$ level in the exhaust gas is low, and particularly when the conduit length $l_{Ac}$ is not smaller than 250 mm, $NO_x$ is substantially saturated in the exhaust gas in a low level. While, when the conduit length $l_{Ac}$ is not larger than 150 mm, a sharp blue flame is formed.

As described above, only when the above described various burner factors are satisfied in a radiant tube burner, low $NO_x$ level combustion can be carried out. For example, according to the present invention, a very low $NO_x$ level, which is lower by at least 30% than the $NO_x$ level attained by the use of a conventional radiant tube burner and shown in FIG. 3, can be attained, and a low $NO_x$ level of about 80 ppm was obtained in the coke oven gas, which is a fuel having the highest $NO_x$ level in the exhaust gas among various fuels.

Figure 7A:
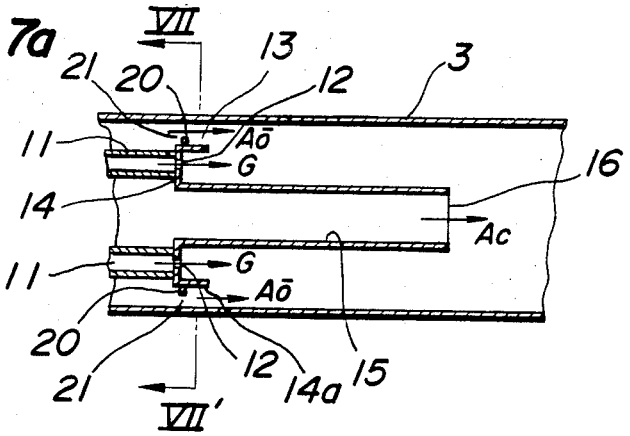
FIG. 7*a* is a longitudinal sectional view of another embodiment of the radiant tube burner according to the present invention.
Figure 7B:
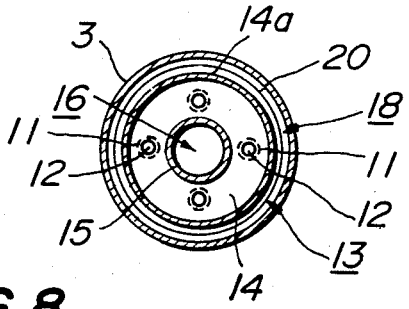
FIG. 7*b* is a cross-sectional view of the radiant tube burner shown in FIG. 7*a* taken on a line VII—VII' in the arrow direction.

FIGS. 7*a* and 7*b* illustrate another embodiment of the radiant tube burner according to the present invention. In the burner illustrated in FIGS. 7*a* and 7*b*, a retention flange 20 for squeezing is arranged in the air-supplying side (upstream side) of the nozzle portion 13 for jetting outer air flow $A\bar{o}$, whereby the inner air flow ratio (Ac ratio) is controlled by the ratio of the area of the inner air flow conduit 15 to the area of the gap 21 formed between the flange 20 and the radiant tube 3, and a fuel gas is burnt. When the burner illustrated in FIGS. 7*a* and 7*b* is used, an outer air flow $A\bar{o}$ squeezed by the retention flange 20 is formed into a steady flow during passing through the chamber 14, but at the same time the outer air flow decreases its flow rate at the outer air flow nozzle portion 13. As the results, the momentum ratio $MG/MA\bar{o}$ shown in FIG. 5 becomes high. Therefore, the use of the retention flange 20 has a merit that fuel gas can be supplied into the primary combustion region $\alpha_1$ at a low jet velocity under a low pressure.

In the practical experiment, the same low $NO_x$ effect was obtained in the gas pressure of 250 mm $H_2O$ in the burner portion of the burner illustrated in FIG. 2*a* and in the gas pressure of 150 mm $H_2O$ in the burner portion of the burner illustrated in FIG. 7*a*.

In the burners shown in both FIGS. 2*a* and 7*a*, the rim 14*a* of the chamber 14 makes the outer air flow $A\bar{o}$ into a steady flow, but when the rim 14*a* is too long, the rim 14*a* makes the fuel gas flow into steady flow at the same time and acts substantially as a nozzle to lower the momentum ratio $MG/MA\bar{o}$ of the fuel gas jet to the outer air flow. Therefore, in the radiant tube burner of the present invention, the length of the rim is limited as follows:

in the burner illustrated in FIG. 2*a*: rim length $\geqq 50$ mm and in the burner illustrated in FIG. 7*a*: rim length $\cong 4 \sim 5$ mm In this specification, the radiant tube burner of the present invention is exemplified by the case wherein the burner is used in the form of a suction-type burner as illustrated in FIG. 1, but the burner of the present invention can be used in the form of a forced draft-type burner, wherein combustion air is forcedly supplied to the burner, and the same low $NO_x$ effect can be obtained in both cases.

Figure 8:
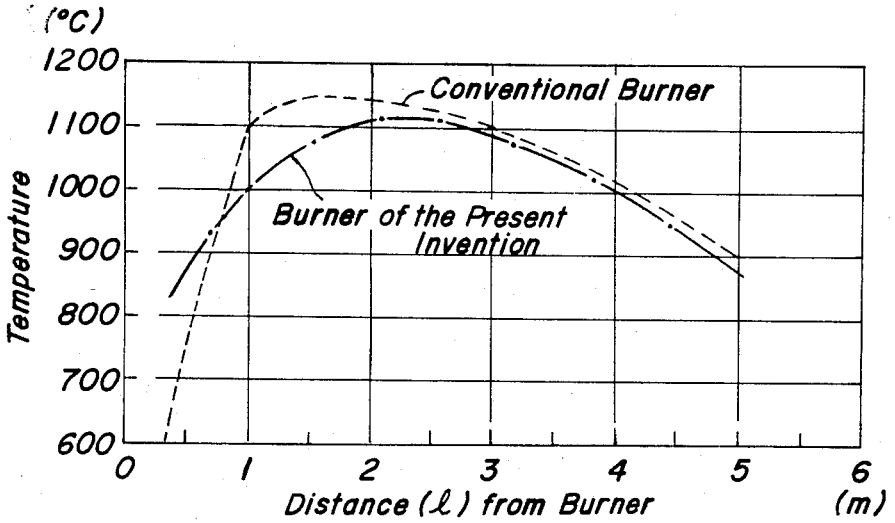
FIG. 8 is a graph showing a comparison of the radiant tube burner of the present invention with a conventional radiant tube burner in the temperature distribution in an annealing furnace.

FIG. 8 shows a comparison of the radiant tube burner of the present invention with a conventional radiant tube burner in the temperature distribution in an annealing furnace. It can be seen from FIG. 8 that the radiant tube burner according to the present invention is more uniform in the temperature distribution in an annealing furnace, is lower in the maximum temperature and is further lower by about 50° C. in the exhaust gas temperature than a conventional radiant tube burner. The low exhaust gas temperature means that fuel cost is low, and 2.5% of energy saving effect was attained by using the radiant tube burner of the present invention.

When fuel gas was burnt under the above described conditions by using the radiant tube burner of the present invention, the fuel gas was able to be burnt in a considerably low $NO_x$ level in the exhaust gas, which was 30~40% lower than the $NO_x$ level in the combustion by means of a conventional radiant tube burner.

What is claimed is:

1. A low NOx level combustion method in a radiant tube burner, the method comprising flowing an inner air flow in an inner air flow conduit connected to a source of combustion air, and arranged centrally of an annular chamber in the radiant tube, the chamber being provided with a base portion connected to the inner air flow conduit and having a rim portion integrally formed at the peripheral edge thereof, said chamber forming in the radiant tube an annular fuel space bounded by the rim portion and the central inner air flow conduit, flowing a fuel gas flow through a plurality of fuel-gas conduits connected at a first end to a fuel gas source and arranged in a circle in the radiant tube so as to surround the inner air flow conduit, said plurality of fuel-gas conduits opening at a second end open into the base portion of said chamber to form fuel-gas openings, said fuel gas openings communicating with the annular fuel space therethrough, jetting the fuel-gas flow into a primary combustion region adjacent to the rim portion of said chamber and surrounding the inner air flow conduit through said fuel-gas openings arranged in said chamber at the second end of said fuel-gas conduits, the inner air flow conduit extending forwardly and downstream of said chamber in the flowing direction of the fuel gas and along a central axis of the radiant tube, jetting the inner air flow into a secondary combustion region through an open end of the inner air flow conduit, and jetting an outer air flow in communication with the combustion air source and surrounding the fuel gas flow into the primary combustion region through a passage formed between the radiant tube and the rim portion of said chamber, the fuel gas being primarily burnt by the outer air flow and then secondarily burnt by the inner air flow, and further comprising jetting the fuel gas flow by means of 3~6 fuel gas openings arranged in said chamber, carrying out a primary combustion of the fuel gas by controlling the ratio of the amount of the inner air flow to the total amount of introduced air to 35–80%, and limiting the momentum ratio of the fuel gas flow to the outer air flow to not lower than 0.40, and further carrying out a secondary combustion of the primarily burnt fuel gas by setting the length of the inner air flow conduit such that the secondary combustion is carried out at a time substantially later than the time of the primary combustion, whereby a uniform and smooth two stage combustion is carried out.

2. A method according to claim 1, further comprising arranging a retention flange on said rim portion in an upstream side of the outer air flow passage for jetting the outer air flow therethrough, whereby the rate of the outer air flow is adjusted, the outer air flow is made into a steady flow, and the fuel gas is primarily burnt by the jet of the steady flow of the outer air flow.

* * * * *